US009931869B2

(12) United States Patent
Ortiz Mompel et al.

(10) Patent No.: US 9,931,869 B2
(45) Date of Patent: Apr. 3, 2018

(54) MEDIA TRANSPORT WITH MEDIA ROLLERS OF DIFFERING DIAMETERS

(71) Applicant: HEWLETT-PACKARD DEVELOPMENT COMPANY, L.P., Houston, TX (US)

(72) Inventors: Josep Ortiz Mompel, Terrassa (ES); Javier Deocon Mir, Sant Cugat del Valles (ES); Eduardo Martin Orue, Sabadell (ES); Joaquim Brugue Garvi, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 10 days.

(21) Appl. No.: 15/207,156

(22) Filed: Jul. 11, 2016

(65) Prior Publication Data

US 2018/0009241 A1 Jan. 11, 2018

(51) Int. Cl.

| | |
|---|---|
| ***B65H 5/02*** | (2006.01) |
| ***B41J 11/04*** | (2006.01) |
| ***B41J 11/00*** | (2006.01) |
| ***B65H 5/06*** | (2006.01) |

(52) U.S. Cl.

CPC ..... *B41J 11/04* (2013.01); *B41J 11/0015* (2013.01); *B65H 5/062* (2013.01); *B65H 2301/5122* (2013.01); *B65H 2403/92* (2013.01)

(58) Field of Classification Search

CPC .. B65H 2301/5122; B65H 2701/11218; B65H 2404/43; B65H 2404/4213

See application file for complete search history.

(56) References Cited

U.S. PATENT DOCUMENTS

| | | | | |
|---|---|---|---|---|
| 4,955,965 | A * | 9/1990 | Mandel | B65H 5/062 271/184 |
| 5,280,901 | A * | 1/1994 | Smith | B65H 29/70 271/188 |
| 5,282,614 | A * | 2/1994 | Kalisiak | B65G 47/244 271/227 |
| 5,904,350 | A | 5/1999 | Creighton et al. | |
| 7,200,356 | B2 * | 4/2007 | Kawamoto | G03G 15/6576 271/188 |
| 7,333,766 | B2 | 2/2008 | Dutoit et al. | |
| 7,976,233 | B2 | 7/2011 | Onuki et al. | |
| 8,073,371 | B2 | 12/2011 | Yamamoto | |
| 8,910,941 | B2 | 12/2014 | Jacobs | |
| 8,925,917 | B2 | 1/2015 | Watanabe et al. | |
| 2015/0360482 | A1 | 12/2015 | Ortiz et al. | |

FOREIGN PATENT DOCUMENTS

JP 2016000630 A 1/2016

* cited by examiner

*Primary Examiner* — Howard J Sanders
(74) *Attorney, Agent, or Firm* — Fabian VanCott

(57) ABSTRACT

In one example in accordance with the present disclosure a media transport device is described. The device includes a number of drive rollers coupled to a frame. A number of media rollers are also coupled to the frame. The media rollers are in contact with, and rotated by, the number of drive rollers. Media rollers in a first set have a first diameter and media rollers in a second set have a second diameter that is different from the first diameter. The device also includes a number of pinch rollers coupled to the frame. The pinch rollers are in contact with the number of media rollers to form a number of nips through which media passes along a feed path.

20 Claims, 7 Drawing Sheets

MEDIA TRANSPORT WITH MEDIA ROLLERS OF DIFFERING DIAMETERS

BACKGROUND

Print media, and devices that generate print media, are ubiquitous in society. For example, individual users, corporations, and other organizations use printing devices, and other devices such as laminators, to produce text or images on media such as paper. Media is introduced into a device where a printing fluid such as ink is deposited on the media. Other operations may also be performed on the print media including laminating, collating, and other finishing operations. In some cases, these printing and additional operations are carried out at high volume. For example, in some applications, a large roll of media, upwards of 150 meters long, may be introduced into a printing device, cut to a desired length, printed on, and then discharged into an output tray.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1A:
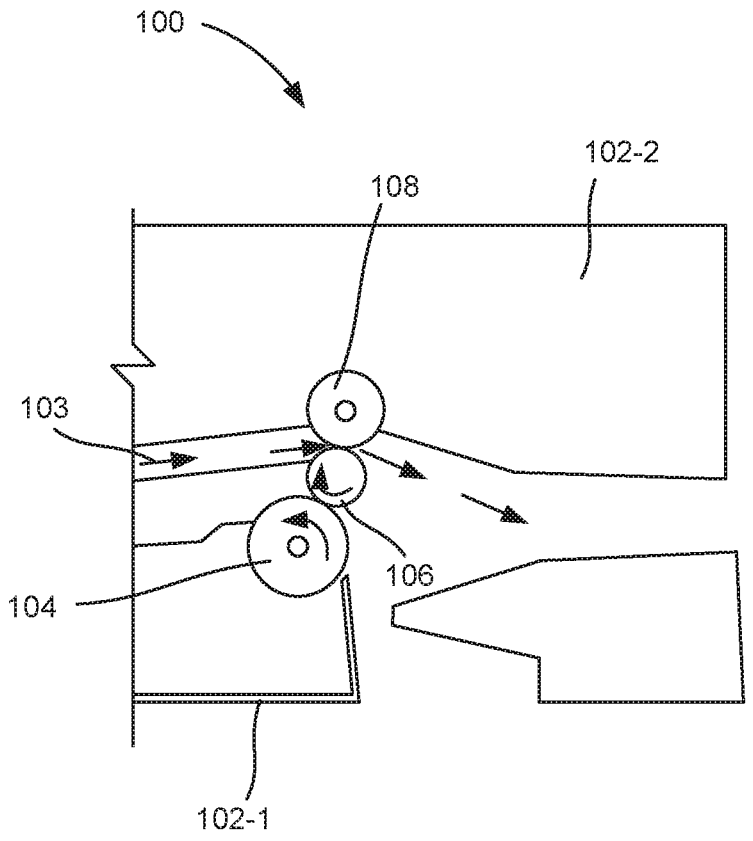
FIGS. 1A-1C are views of a media transport device, according to an example of the principles described herein.

Print media, and devices that generate print media, are ubiquitous in society. For example, individual users, corporations, and other organizations use printing devices, and other devices such as laminators, to produce text or images on media such as paper and to otherwise create a finished media project. In these cases, media is introduced into a device where a printing fluid such as ink is deposited on the media. Other operations may also be performed on the print media including, among others laminating and collating. In some cases, these printing and additional operations are carried out at high volume. For example, in some applications, a large roll of media, upwards of 150 meters long, is introduced into a printing device, cut to a desired length, printed on, and then discharged into an output tray.

A media transport device moves the media throughout the device while these various operations are performed. In some examples, the media transport device includes a variety of rollers that are driven by shafts, belts or other components. Throughout the device pairs of rollers may pinch together along a radial surface. The contact point of these paired rollers forms a nip. Media is passed through the nip and the friction force of the rollers on both sides of the media advance the media along a feed path for processing.

While such large scale printing devices have greatly increased printing capacity, some characteristics can affect their efficient implementation. For example, in some cases media is wound as a roll. When unwound from such a roll, the media may have a propensity to curl. This tendency of the media to roll, curl, or buckle, can complicate printing and other operations. While such curling may not be an issue when being acted upon by rollers moving the media along the feed path, when no longer supported by the rollers, the curling can impact various operations.

For example, during ejection of the print media from the system, such a buckling effect can cause media jams, thus impacting the functioning of the printing device. More specifically, a buckling leading edge of exiting print media can collide with the output tray at an angle where friction between the leading edge and the output tray prevents full ejection of the print media from the printing system. A less than complete ejection could block the output channel, causing a jam of subsequent sheets of print media. In another example, a curling trailing edge of exiting print can similarly not full eject from the system, which similarly blocks the output channel and causes a media jam in the printing device.

These complications are exacerbated when printing on thin media due to their low mass and the softening effect of printing fluid. Thicker media is also an issue as it is prone to retain a form of a roll even after leaving the roll. While curling due to a media being would around a roll is described, other factors could introduce curl into a media, and thereby increase a likelihood of buckling. For example, the deposition of printing fluid on a media could reduce the stiffness of the media making it more susceptible to curl and buckling and coatings deposited on the surface of the media could similarly increase the curl of the media.

In some cases, narrow output channels are used in an attempt to reduce the effects of media buckling. While light buckling is still prevalent, the narrow output channel prevents such buckling that would result in a jam. However, with these narrow output channels the media is more likely to come into contact with the channel walls, ceiling, or floor. Such contact with wet printing fluid on the print medium can result in smearing or smudging of the print fluid.

Accordingly, the present specification describes devices and systems for reducing the tendency of the print media to buckle downstream of paired rollers. This may be accomplished by increasing the rigidity of the print media in a direction perpendicular to a buckling direction. As the present devices and systems do not rely on narrow channels, the present devices and systems also reduce the likelihood of smudging or smearing of the printing fluid on the print media, thus increasing the quality of the final product. Specifically, the present specification corrugates the media in a direction perpendicular to a buckling direction of the print media as it leaves the printing system, or other system in which the media is processed. This is done by using a series of media rollers, which are aligned perpendicular to the direction of the feed path and which have different diameters.

In using the devices and systems described herein, the media is corrugated perpendicular to a likely curling direction. As the print media bends in one direction, this corrugation effectively holds media cantilevered well past the rollers that generate such corrugation. The increased rigidity of the print media due to the corrugation reduces the likelihood of buckling of the media both at its leading edge and its trailing edge, thus reducing the likelihood of jamming that can result from such buckling.

Specifically, the present specification describes a media transport device. The media transport device includes a number of drive rollers coupled to a frame. A number of media rollers are also coupled to the frame. The media rollers are in contact with, and rotated by, the number of drive rollers. Within the number of media rollers, is a first set of media rollers that have a first diameter and a second set of media rollers that have a second diameter that is different from the first diameter. The device also includes a number of pinch rollers coupled to the frame. The pinch rollers are in contact with the number of media rollers to form a number of nips through which media passes along a feed path.

The present specification also describes a system. The system includes a printing device to deposit a printing fluid on a media. The system also includes a media transport device. The media transport device includes a number of drive rollers coupled to a frame to drive a number of media rollers. The number of media rollers are also coupled to the frame and are in tangential contact with, and rotated by, the number of drive rollers. The media rollers drive media to an output tray. Media rollers of a first set have a first diameter and media rollers of a second set have a second diameter that is different from the first diameter. A number of pinch rollers coupled to the frame and in tangential contact with the number of media rollers form a number of nips to generate a driving friction on the media along the feed path.

The present disclosure also describes a media transport device. The media transport device includes multiple input drive rollers coupled to a frame to move incoming media along a feed path. Multiple output drive rollers of the device are also coupled to the frame. Each output drive roller rotates a corresponding media roller. The multiple media rollers are also coupled to the frame. Each media roller is in tangential contact with, and rotated by, a corresponding output drive roller. Media rollers of a first set have a first diameter and media rollers of a second set have a second diameter that is different from the first diameter. Media rollers from the first set and second set alternate along a direction perpendicular to the feed path of the media. The device also includes multiple pinch rollers coupled to the frame. Each pinch roller is in contact with a corresponding media roller to form a number of nips through which media passes along the feed path. The device further includes multiple pivot arms, each pivot arm to hingedly position a corresponding media roller against a corresponding output drive roller.

Using such a media transport device 1) generates corrugation in the media without differential velocities among the media rollers; 2) prevents marring of the print media due to slippage; 2) increases the rigidity of the print media to reduce the likelihood of media buckling; 3) providing media transport that is not dependent upon media stiffness; 4) provides space between adjacent drive rollers to integrate other components; 5) allows for easy synchronization of input and output drive rollers; and 6) provides a closed paper path to facilitate directed media transport. However, it is contemplated that the devices disclosed herein may provide useful in addressing other matters and deficiencies in a number of technical areas. Therefore, the systems and methods disclosed herein should not be construed as addressing any of the particular matters.

As used in the present specification and in the appended claims, the term "nip" refers to a contact point between paired rollers through which the print media passes along a media path.

Further, as used in the present specification and in the appended claims, the term "pair-wise grouping" refers to a pairing of particular rollers. For example, a pair-wise grouping of media rollers and drive rollers indicates that one media roller corresponds to, and is in tangential contact with one drive roller. In another example, a pair-wise grouping of media rollers and pinch rollers indicates that one media roller corresponds to, and is in tangential contact with one pinch roller.

Further, as used in the present specification and in the appended claims, the term "a number of" or similar language is meant to be understood broadly as any positive number comprising 1 to infinity.

In the following description, for purposes of explanation, numerous specific details are set forth in order to provide a thorough understanding of the present systems and methods. However, in other examples, the present apparatus, systems, and methods may be practiced without these specific details. Reference in the specification to "an example" or similar language means that a particular feature, structure, or characteristic described in connection with that example is included as described, but may not be included in other examples.

Figure 1B:
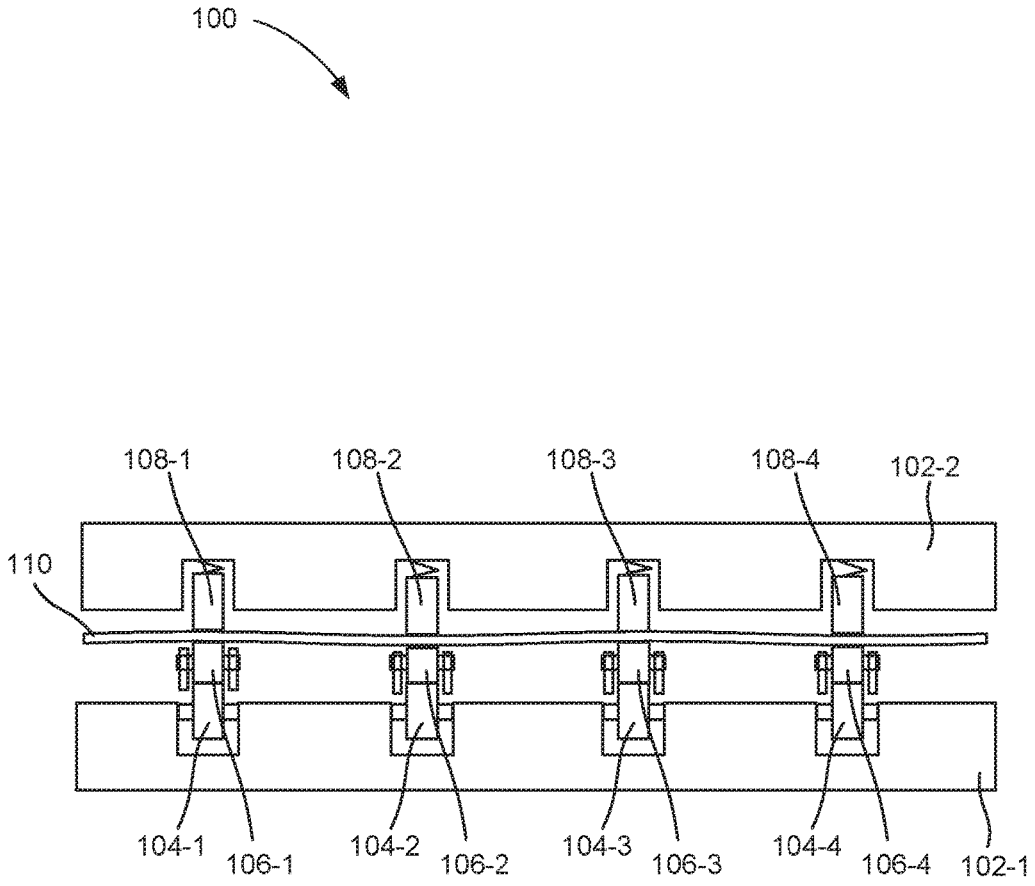
Figure 1C:
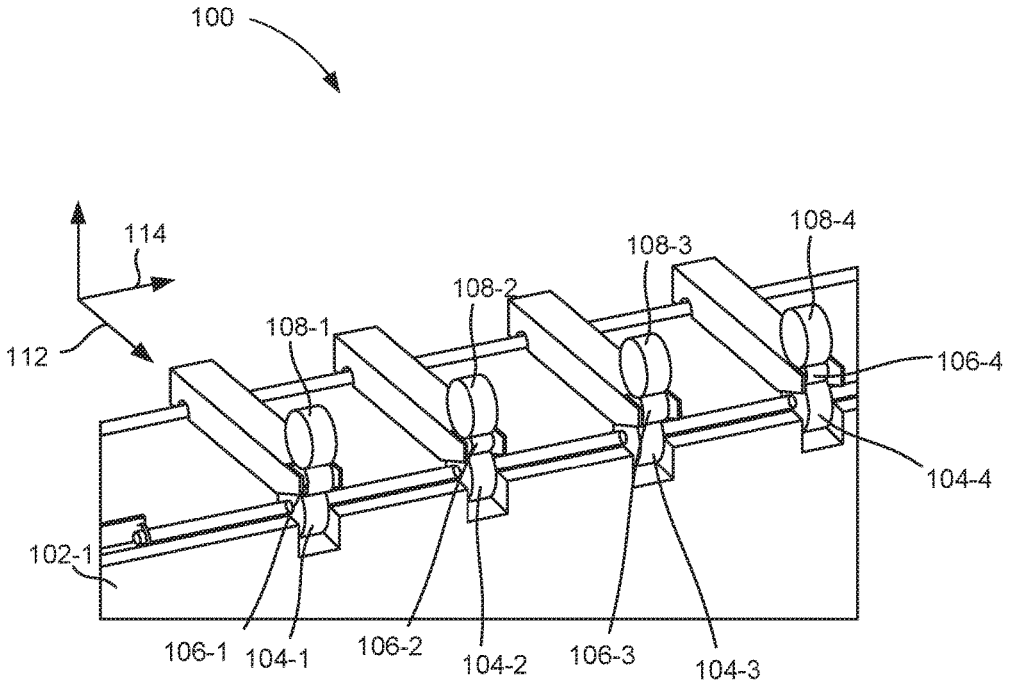

Turning now to the figures, FIGS. 1A-1C are views of a media transport device (100) according to an example of the principles described herein. Specifically, FIG. 1A is a side view of the media transport device (100), FIG. 1B is a front view of the media transport device (100), and FIG. 1C is an isometric view of the media transport device (100). As described above, due to the effect of storing media as a cylindrical roll, depositing printing fluid onto a media, and depositing a coating over the media, among other operations, the media may be prone to curling. This curling, if left unattended can block an output channel thus causing a jam of the media transport device (100) and the larger system in which it is incorporated. Accordingly, the present specification describes a media transport device (100) that 1) moves media along a feed path where it is printed on or otherwise processed and 2) reduces the likelihood of path blockage by increasing the rigidity of the media in a direction perpendicular to the feed path and the likely direction of buckling of the print media.

To carry out this function, the media transport device (100) includes a number of rollers which are aligned and positioned via a frame of the media transport device (100). In other words, the media transport device (100) frame provides a structure and allows for the alignment of the different rollers so as to facilitate media movement along the feed path while processing operations are carried out on the media. Different components of the media transport device (100) may be coupled to different portions of the frame. For example, pinch rollers (108) may be mounted to a top portion (102-2) of the frame and drive rollers (104) and media rollers (106) may be coupled to a bottom portion (102-1) of the frame.

Returning to the rollers, a first set of rollers referred to as drive rollers (104) are coupled to a frame of the media transport device (100). The drive rollers (104) transmit power from a motor or other source of motion and assist in propelling the media along the feed path (103). Accordingly, the drive rollers (104) may be coupled to a shaft, belt, chain, or other motion-imparting component which motion-imparting component operates to rotate the drive rollers (104). As depicted in FIGS. 1B and 1C, a number of the drive rollers (104-1, 104-2, 104-3, 104-4) may be spaced along an axis perpendicular to the feed path (103) of the print media. In other words, the number of drive rollers (104) may be spaced along a width of the print media as it moves along a feed path (103).

The drive rollers (104) are in tangential contact with media rollers (106). Accordingly, as the drive rollers (104)

rotate, a frictional force causes the drive rollers (104) to rotate the media rollers (106). More specifically, as the drive rollers (104) rotate in a first direction, a counter-clockwise direction as depicted in FIG. 1A, a frictional force causes the media roller (106) to rotate in a second direction, a clockwise direction as depicted in FIG. 1B, to propel the media along the feed path (103). To transfer motion from the drive rollers (104) to the media rollers (106), the drive rollers (104) and the media rollers (106) may be formed out a rubber material, or other material that has a sufficiently large coefficient of friction to rotate the media rollers (106).

A number of pinch rollers (108) are in tangential contact with the media rollers (106). The point of contact between a media roller (106) and a pinch roller (108) forms a nip through which the media passes. The combined workings of the media rollers (106) and the pinch rollers (108) move the media along the feed path (103) due to a frictional force between the rollers and the media. Using multiple rollers, i.e., drive rollers (104) and media rollers (106), as opposed to a single roller allows the drive roller (104) and the media roller (106) to be smaller, which offers a shorter distance from the nip to the falling point, thus easing trailing edge ejection.

As described above, and as clearly indicated in FIG. 1B, the media rollers (106) may be divided into different sets. A first set of media rollers (106) may have a first diameter and a second set of media rollers (106) have a second diameter. The media rollers (106) which are along a width of the print media, i.e., perpendicular to the feed path of the media, alternate between the first set and the second set. For example, a first media roller (106-1) and a third media roller (106-3) may be of the first set and have a first diameter. The alternating rollers, i.e., a second media roller (106-2) and a fourth media roller (106-4), may belong to the second set. Such an alternating arrangement of media rollers (106) with different diameters imparts a corrugation to the media along a width of the media (110) which corrugation is depicted in FIG. 1B. While FIG. 1B specifically depicts two sets of media rollers (106) with two diameter sizes, any number of sets of media rollers (106) may be used with any number of diameter sizes for the different sets.

This corrugating effect is enhanced by the pinch rollers (108-1, 108-2, 108-3, 108-4) which are biased against the media rollers (106). More specifically, as can be seen in FIG. 1B, the pinch rollers (108) are biased towards the media rollers (106) for example, via a spring force. The pinch rollers (108) thus counter a tendency of the media (110) in a perpendicular direction to remain flat and force a corrugation on the media (110).

The corrugation of the media (110) increases the rigidity of the media (110), preventing an upward or downward curl of the media (110) along the feed path (103). Increasing the rigidity in the transverse direction, i.e. the width direction, prevents buckling in the length direction. Thus, rather than curling upon exit, the media (110) exhibits a greater inertia to such bending, thus reducing the likelihood of curling and any correspondent jamming of the media transport device (100).

FIGS. 1B and 1C also depict the pair-wise grouping of the various rollers. For simplicity some of the components of the media transport device (100) are omitted from FIG. 1C, such as a top portion (102-2) of the frame to which the pinch rollers (108) are coupled. Returning to the rollers, the number of media rollers (106) are in a pair-wise grouping with the number of drive rollers (104), meaning that the various number of rollers are grouped as pairs. For example, a first drive roller (104-1) is paired with a first media roller (106-1), a second drive roller (104-2) is paired with a second media roller (106-2), and so on. Similarly, the number of pinch rollers (108) are in a pair-wise grouping with the number of media rollers (106). For example, a first pinch roller (108-1) is paired with the first media roller (106-1), a second pinch roller (108-2) is paired with the second media roller (108-1), and so on. While FIGS. 1B and 1C depict multiple drive rollers (104), in some examples, a single drive roller (104) could be in contact with, and rotate the multiple media rollers (106).

In FIG. 1C, the direction of the feed path corresponds to the direction indicated by the arrow (112). As such, the corrugation is imparted along, and the rollers are spaced along, a direction perpendicular to the feed path (103), which perpendicular direction is indicated by the arrow (114).

With the media corrugated as depicted in FIGS. 1A-1C, the paper or other media (110) is less likely to curl up or down in the direction of the feed path (103), especially after exiting from the media transport device (100) to be placed on an output tray. Thus, the media (110) is less likely to interfere with the ejection of subsequent sheets of media (110) from the system in which the media transport device (100) is incorporated. In other words, the corrugation increases the rigidity in a transverse direction to the feed path (103) and therefore decreases the likelihood of bending in the feed path (103) direction. The corrugated shape of the media (110) generated by the alternating diameters of the media rollers (106) when ejecting the media increases the inertia and rigidity of a cantilevered portion of the leading edge thus allowing a robust landing of the media (110) on an output tray.

Moreover, due to the nip between the pinch rollers (108) and the media rollers (106), the movement of the media (110) is driven by friction, and not driven by the stiffness of the media (110), thus enhancing the processing of thin media.

Moreover, as the speed of the rotation of media rollers (106) is independent of the media roller (106) diameter, but is rather a function of the tangential velocity of the media rollers (106), there is no slippage between adjacent media rollers (106) so as to cause markings, smudges or other imperfections on the surface of the print media (110). In other words, the tangential velocity of each of the media rollers (106) regardless of what set it is in, is the same as other media rollers (106). Still further, as each media roller (106) operates in conjunction with a corresponding pinch roller (108), a controllable pressure is provided that is independent of media stiffness.

Figure 2:
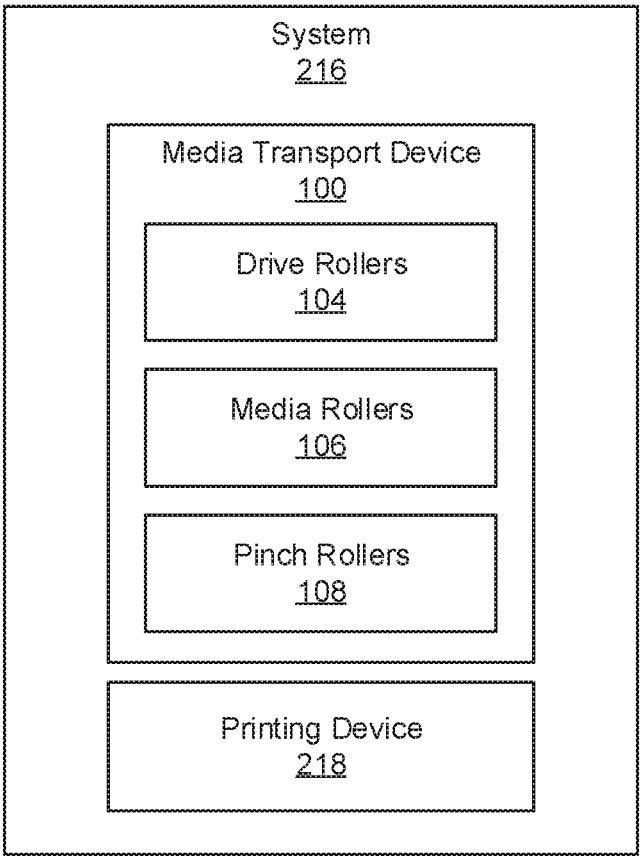
FIG. 2 is a block diagram of a system incorporating a media transport device, according to an example of the principles described herein.

FIG. 2 is a block diagram of a system (216) incorporating a media transport device (100), according to an example of the principles described herein. As described above, in some examples, the media transport device (100) may be incorporated into a larger system (216). Such a system (216) may be a printing system that among other things deposits a print fluid such as ink onto a media (FIG. 1, 110). Other examples of devices that may be included in such a system (216) are a laminating device, a cutting device, or any other type of device that assists in generating a final product.

As a specific example, the system (216) may include a printing device (218) that deposits a printing fluid on a media (FIG. 1, 110). One example of a print fluid is ink, which may be deposited on a media (FIG. 1, 110) such as paper to form text or images on the media (FIG. 1, 110). While specific reference is made to ink as a printing fluid, other types of printing fluids may be used as well. Moreover, while specific reference is made to paper as a print media, other forms of print media may also be used including vinyl, plastic, or another substrate.

The system (216) also includes the media transport device (100) which as described above includes a number of drive rollers (104) that are coupled to a frame. The drive rollers (104) are driven by a motor, and in turn drive, or rotate, media rollers (106). The media rollers (106) interact with the media (FIG. 1, 110) to direct the media (FIG. 1, 110) throughout the system (216), for example to an output tray of a printing system. As described above, a grouping of media rollers (106) may be aligned along a direction perpendicular to the feed path (FIG. 1, 103), and may have alternating larger and smaller diameters. Doing so imparts a corrugated profile along a width of the media (FIG. 1, 110) to enhance rigidity along the width of the media (FIG. 1, 110). While specific reference is made to two different sets of media rollers (106) having two distinct diameters, any number of sets of media rollers (106) having any number of distinct diameters can be used to produce the desired corrugation.

To provide a more defined corrugation, the media transport device (100) includes pinch rollers (108). The pinch rollers (108) are biased towards the media rollers (106) and compress the media (FIG. 1, 110) against the corresponding media rollers (106). Not only do the pinch rollers (108) and media rollers (106) impart a corrugation to the exiting media (FIG. 1, 110), but they also provide a driving force to eject the media (FIG. 1, 110) from the system (216). In other words, a friction force generated by the rollers, which may be formed of rubber, drives the paper along the feed path (FIG. 1, 103). Corrugating the print media as described above, enhances the operation of a system as it decreases the likelihood of jamming of the media (FIG. 1, 110).

Figure 3:
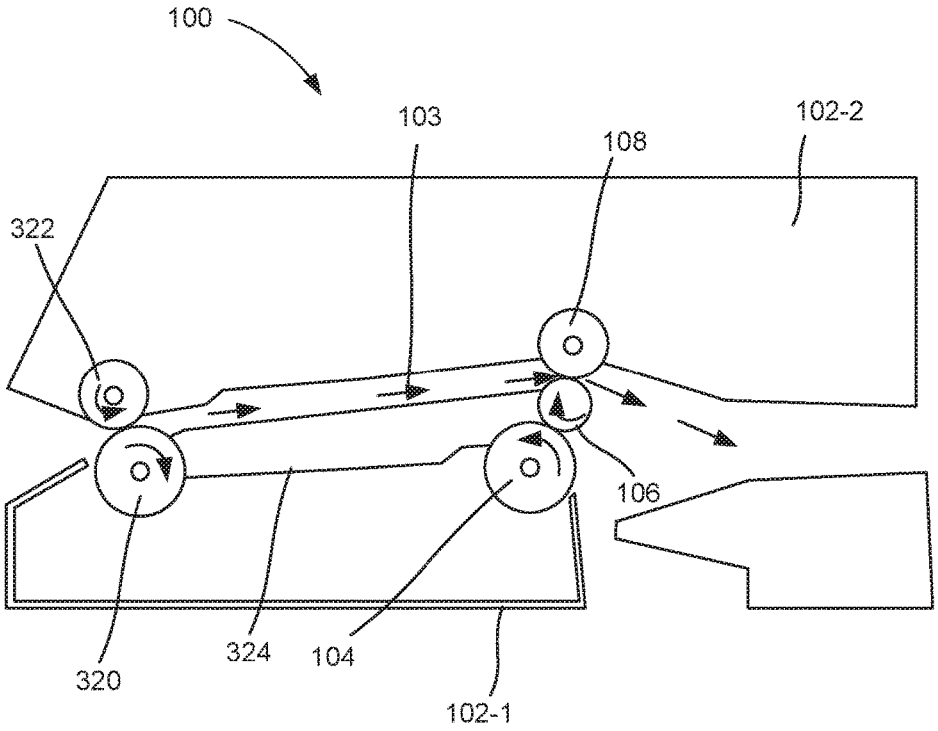
FIG. 3 is a side view of a media transport device, according to an example of the principles described herein.

FIG. 3 is a side view of a media transport device (100), according to an example of the principles described herein. As depicted in previous figures, the media transport device (100) includes a frame and multiple drive rollers (104) coupled to the frame. Moreover, as described above each drive roller (104) is paired with a media roller (106). In other words, each of the drive rollers (104) rotates a corresponding media roller (106). Within the media rollers (106), a first set have a first diameter and a second set have a second diameter which are alternated along a width of the media (FIG. 1, 110) so as to impart a corrugation along the width of the media (FIG. 1, 110), perpendicular to the feed path (FIG. 1, 103), and perpendicular to a direction of buckling of the media (FIG. 1, 110).

Still further, as described above, multiple pinch rollers (108), each in tangential contact with a corresponding media roller (106), function to create a pressure nip through which the media (FIG. 1, 110) passes and which increases the corrugation of the media (FIG. 1, 110). The media transport device (100) also includes a number of input drive rollers (320). The input drive rollers (320) similar to the output drive rollers (104) are rotated by a motor, via a shaft, belt, chain or other motion-imparting component. The input drive rollers (320) propel the media (FIG. 1, 110) along the feed path (103). Similar to the output pinch rollers (108), input pinch rollers (322) correspond to the input drive rollers (320) to provide friction which propels the media (FIG. 1, 110) along the feed path (103). The input drive rollers (320) and the input pinch rollers (322) serve to further regulate the path of the media (FIG. 1, 110) along the feed path (103) and ensure that the media (FIG. 1, 110) properly advances through the system.

In some examples, the input drive rollers (320) and the output drive rollers (104) have the same diameter. Doing so allows for easy synchronization of the speed of the rollers. For example, if the input drive rollers (320) propel the media (FIG. 1, 110) along the feed path (FIG. 1, 103) at a different rate than the output drive rollers (104), there is a chance for backup, or otherwise jamming the media transport device (100). Accordingly, it is desirable that the speed of movement of media (FIG. 1, 110) along the feed path (FIG. 1, 103) be relatively consistent. With the input drive roller (320) and the output drive roller (104) having the same diameter, the synchronization of these rollers to move the media (FIG. 1, 110) at the same rate is simplified. In some examples, one motor, and/or one reduction mechanism can be used to drive both the input drive roller (320) and the output drive roller (104). This results in enhanced performance and simplified manufacturing costs, both of which can result in cost reduction and increased customer satisfaction.

Figure 5:
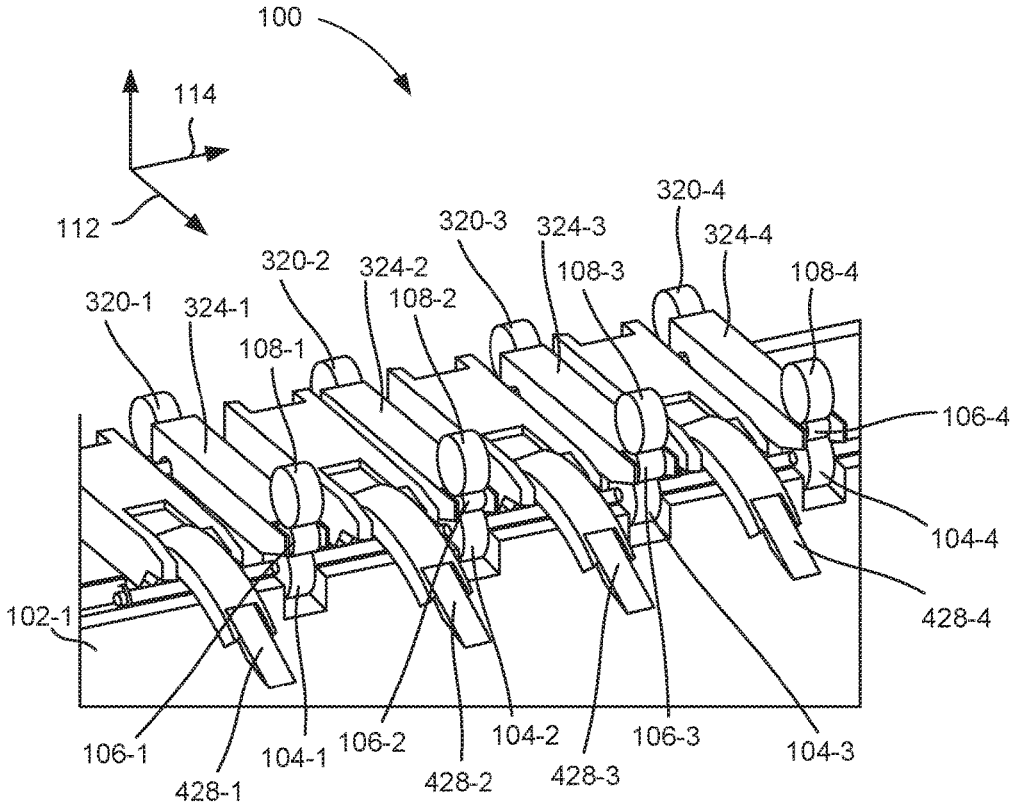
FIG. 5 is an isometric view of the media transport device, according to an example of the principles described herein.

As can be seen in FIG. 3, the media transport device (100) also includes multiple pivot arms (324). As FIG. 3 is a side view it appears to depict a single pivot arm (324). However, as can be seen in FIG. 5, there are actually multiple pivot arms (324). The pivot arms (324) of the media transport device (100) are coupled to a corresponding media roller (106) and hingedly position the media roller (106) against a corresponding output drive roller (104). To accomplish this pivot motion, the pivot arms (324) may rotate about a shaft to pivot and raise and lower the media rollers (106) against the drive rollers (104). In this fashion, the media transport device (100), and more specifically, the pivot arms (324) that hold them in place, can accommodate media rollers (106) of different diameters. In other words, the various pivot arms (324) can be the same dimensionally regardless of the diameter, i.e., which set, of the media roller (106) is coupled to that particular pivot arm (324). Accordingly, the pivot arms (324) can be used in different applications using different sized media rollers (106). Or in another example, existing media rollers (106) could be replaced with other, different-sized media rollers (106) to accommodate different properties of the system such as different media sizes, different media thicknesses, different printing fluids, or different media operations.

The pivot arms (324) also provide a base on which the media (FIG. 1, 110) may rest on when being transported through the system. In other words, without the pivot arms (324), media (FIG. 1, 110) may pass between the input drive rollers (320) and the output drive rollers (104) to interfere with other components of the system and potentially causing system jams.

Figure 4:
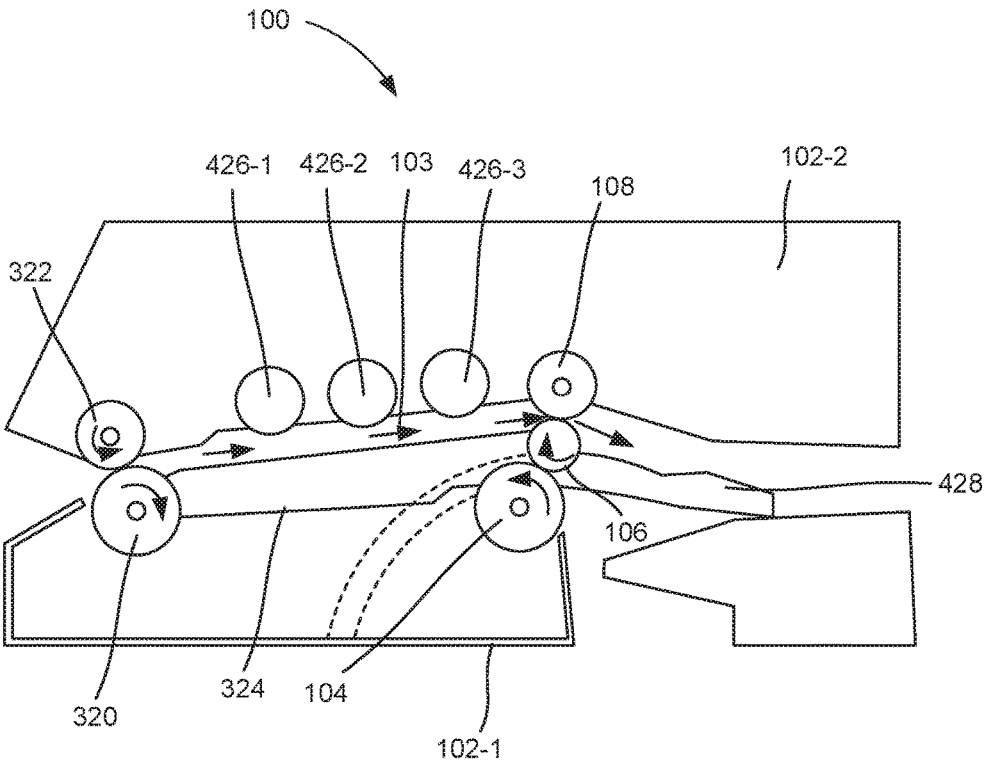
FIG. 4 is a side view of a media transport device, according to an example of the principles described herein.

FIG. 4 is a side view of a media transport device (100), according to an example of the principles described herein. In some examples, in addition to the rollers (104, 106, 108, 320, 322) and frame, the media transport device (100) may include a number of free wheels (426-1, 426-2, 426-3). The free wheels (426) may be either driven, i.e., via a motor, or may be passive, meaning they rotate when contacted by an incoming media sheet. The free wheels (426) function to keep the media (FIG. 1, 110) moving along the feed path (FIG. 1, 103). For example, as media (FIG. 1, 110) comes into the system, a media sheet may be inclined to contact a top portion (102-2) of the frame. In some examples, such a contact can be at significant enough of an angle, or at high enough velocity to cause a media jam. However, the free wheels (426) may intercept this media (FIG. 1, 110), and direct it along a feed path (FIG. 1, 103) between the media rollers (106) and the pinch rollers (108). Using rollers to guide the motion of media (FIG. 1, 110), as opposed to just a flat surface of the underside of the frame, reduces the surface that comes into contact with the media (FIG. 1, 110). Any contact by a surface with the media (FIG. 1, 110) 1) introduces likelihood for buckling and consequently media jams and 2) could interact with the printing fluid on the media surface, which may still be wet, and thereby create smudges or smears of the printing fluid of the media (FIG. 1, 110), thereby affecting its quality. Accordingly, the free wheels (426) with less contact with the media (FIG. 1, 110), are less likely to smear or smudge the printing fluid on the media surface while still advancing the media (FIG. 1, 110) along the feed path (FIG. 1, 103).

In some examples, any of the rollers, i.e., the drive rollers (104, 3206), media rollers (106), pinch rollers (108, 322) and any of the free wheels (426) have a non-circular cross-section. For example, rollers, or free wheels (426) may have a star-like cross-section. Using a non-circular cross section, such as a star cross section further reduces the likelihood of smearing or smudging by reducing the portion of the roller that comes into contact with the media (FIG. 1, 110). For example, rather than an entire diameter of a circular roller coming into contact with the media (FIG. 1, 110), just the points of the star, or non-circular cross sectional roller come into contact with the media (FIG. 1, 110).

As indicated in previous figures, the media rollers (106) may be spaced along a direction perpendicular to the feed path (103). In some examples, other mechanisms may be inserted between adjacent media rollers (106). For example, as depicted in FIG. 4 and later in FIG. 5, guides (428) may be disposed between adjacent media rollers (106). Such guides (428) guide the media (FIG. 1, 110) to be placed on an output tray of the media transport device (100). The guides (428) therefore enhance the precision of placement of the media (FIG. 1, 110) on the output tray, again reducing the likelihood of media jamming resulting from ejecting the media (FIG. 1, 110) from the media transport device (100). In some examples, the guides (428) are retractable. For example, during printing or other operations, the guides (428) may retract and extend a number of times, the timing of such retraction and extension based on the cyclic ejection of media (FIG. 1, 110) from the media transport device (100).

FIG. 5 is an isometric view of the media transport device (100), according to an example of the principles described herein. For simplicity and clarity of illustration, in FIG. 5, illustrations of some of the components have been removed. For example, the input pinches (FIG. 3, 322) and top portion (FIG. 1, 102-2) of the frame have been removed from view, yet are still part of the media transport device (100). FIG. 5 depicts the placement of the retractable guides (428-1, 428-2, 428-3, 428-4) between adjacent media rollers (106). The retractable guides (428) form a bottom surface bridging a space between an output tray and the nip such that the leading edge of the media (FIG. 1, 110) is not allowed to contact the output tray at such an angle as to cause improper ejection of the media (FIG. 1, 110). Still further, as a guide (428) extends in conjunction with an exiting media sheet, the motion of the guide (428) extending, propels the media (FIG. 1, 110) out of the exit nip, thus reducing the likelihood that a trailing edge of the media (FIG. 1, 110) would improperly eject form the exit nip and cause a media jam.

Using such a media transport device 1) generates corrugation in the media without differential velocities among the media rollers; 2) prevents marring of the print media due to slippage; 2) increases the rigidity of the print media to reduce the likelihood of media buckling; 3) providing media transport that is not dependent upon media stiffness; 4) provides space between adjacent drive rollers to integrate other components; 5) allows for easy synchronization of input and output drive rollers; and 6) provides a closed paper path to facilitate directed media transport. However, it is contemplated that the devices disclosed herein may provide useful in addressing other matters and deficiencies in a number of technical areas. Therefore, the systems and methods disclosed herein should not be construed as addressing any of the particular matters.

The preceding description has been presented to illustrate and describe examples of the principles described. This description is not intended to be exhaustive or to limit these principles to any precise form disclosed. Many modifications and variations are possible in light of the above teaching.

What is claimed is:

1. A media transport device comprising:

a number of drive rollers coupled to a frame;

a number of media rollers coupled to the frame, which media rollers are in contact with, and rotated by, the number of drive rollers, wherein:

media rollers in a first set have a first diameter; and media rollers in a second set have a second diameter that is different from the first diameter; and a number of pinch rollers coupled to the frame, which pinch rollers are in contact with the number of media rollers to form a number of nips through which media passes along a feed path.

2. The device of claim 1, wherein:

the number of media rollers are in a pair-wise grouping with the number of drive rollers; and the number of pinch rollers are in a pair-wise grouping with the number of media rollers.

3. The device of claim 1, wherein the number of drive rollers comprise a single drive roller that is in contact with, and rotates the number of media rollers.

4. The device of claim 1, wherein the media rollers in a direction perpendicular to the feed path alternate between those of the first set and those of the second set to corrugate the media along a media width.

5. The device of claim 4, further comprising a number of retractable guides disposed between adjacent media rollers along the direction perpendicular to the feed path.

6. The device of claim 5, wherein the tangential speed for the number of media rollers of the first set is the same as a tangential speed for the number of media rollers of the second set.

7. The device of claim 5, wherein the number of retractable guides retract based on a cyclic ejection of media from a media transport device.

8. The device of claim 1, wherein:

the number of drive rollers and the number of media rollers are on a first side of media as it passes along a feed path; and the number of pinch rollers are on a second, and opposite, side of the media as it passes along the feed path.

9. The device of claim 1, wherein each drive roller drives a corresponding media roller due to a frictional force therebetween.

10. A system comprising:

a printing device to deposit a printing fluid on a media; and a media transport device comprising:

a number of drive rollers coupled to a frame to drive a number of media rollers;

the number of media rollers coupled to the frame and in tangential contact with, and rotated by, the number of drive rollers to drive media to an output tray, wherein:

media rollers of a first set have a first diameter; and media rollers of a second set have a second diameter that is different from the first diameter; and a number of pinch rollers coupled to the frame and in tangential contact with the number of media rollers to form a number of nips to generate a driving friction on the media along the feed path.

11. The system of claim 10, wherein:

the number of media rollers are in a pair-wise grouping with the number of drive rollers; and the number of pinch rollers are in a pair-wise grouping with the number of media rollers.

12. The system of claim 10, further comprising a number of free wheels disposed on a same side of the feed path as the number of pinch rollers to direct the media along the feed path.

13. The system of claim 10, wherein media rollers in a direction perpendicular to the feed path alternate between the first set and the second set to corrugate the media along a media width.

14. A media transport device comprising:

multiple input drive rollers coupled to a frame to move incoming media along a feed path;

multiple output drive rollers coupled to the frame, each output drive roller to rotate a corresponding media roller;

multiple media rollers coupled to the frame, each media roller in tangential contact with, and rotated by a corresponding output drive roller wherein:

media rollers of a first set have a first diameter;

media rollers of a second set have a second diameter that is different from the first diameter; and media rollers from the first set and second set alternate along a direction perpendicular to the feed path of the media;

multiple pinch rollers coupled to the frame, each pinch roller in contact with a corresponding media roller to form a number of nips through which media passes along the feed path; and multiple pivot arms, each pivot arm to hingedly position a corresponding media roller against a corresponding output drive roller.

15. The device of claim 14, wherein a pivot arm accommodates media rollers of different diameters.

16. The device of claim 14, wherein the multiple input drive roll the multiple output drive rollers have the same diameter.

17. The device of claim 14, wherein the multiple input drive rollers and the multiple output drive rollers are driven by a single motor.

18. The device of claim 14, further comprising a number of input pinch rollers, each input pinch roller in tangential contact with a corresponding input pinch roller.

19. The device of claim 14, wherein the multiple pivot arms comprise a base on which the media rests as it travels along the teed path.

20. The device of claim 14, wherein:

the multiple output drive rollers and the multiple media rollers are coupled to a bottom portion of the frame; and the multiple pinch rollers are coupled to a top portion of the frame.

* * * * *